US006228144B1

(12) United States Patent
Shirasawa et al.

(10) Patent No.: US 6,228,144 B1
(45) Date of Patent: May 8, 2001

(54) METHOD FOR OPERATING WASTE HEAT BOILER IN FLASH-SMELTING FURNACE

(75) Inventors: Tsuneo Shirasawa; Izumi Kawaguchi; Yoshihiko Hoshikawa; Koji Yamada, all of Tokyo (JP)

(73) Assignees: Dowa Mining Co., Ltd.; Kosaka Smelting & Refining Co., Ltd., both of Tokyo (JP)

( * ) Notice: Subject to any disclaimer, the term of this patent is extended or adjusted under 35 U.S.C. 154(b) by 0 days.

(21) Appl. No.: 09/327,614

(22) Filed: Jun. 8, 1999

(30) Foreign Application Priority Data

Aug. 28, 1997 (JP) ..... 9-232645

(51) Int. Cl.[7] ..... C22B 15/06

(52) U.S. Cl. ..... 75/641; 266/44; 266/155; 122/7 R

(58) Field of Search ..... 75/641, 639; 266/44, 266/155; 122/7 R

(56) References Cited

U.S. PATENT DOCUMENTS 5,326,081 * 7/1994 Arpalahti ..... 266/44

FOREIGN PATENT DOCUMENTS

1379168 * 1/1975 (GB) .
6-347001 12/1994 (JP) .

* cited by examiner

*Primary Examiner*—Roy King
*Assistant Examiner*—Tima McGuthry-Banks
(74) *Attorney, Agent, or Firm*—Oliff & Berridge, PLC

(57) ABSTRACT

In a copper flash-smelting works, forced oxidation of dust is prevented, adhesion of dust to a boiler water tube is reduced, and on-line ratio and productivity index is improved. The temperature at the WHB radiation section outlet is greatly reduced and the atmosphere within the WHB radiation section is controlled by blowing the mixed gas of nitrogen gas and air from the feed aperture established in the wall into the boiler radiation section of the waste heat boiler of the flash-smelting furnace in a copper flash-smelting works.

6 Claims, 2 Drawing Sheets

METHOD FOR OPERATING WASTE HEAT BOILER IN FLASH-SMELTING FURNACE

BACKGROUND OF THE INVENTION

1. Field of the Invention

The present invention relates to a method for operating a waste heat boiler in copper flash-smelting works, and more particularly to a technique for preventing accretion build-up by reducing the quantity of dust accretion to the water tube laid within the waste heat boiler in the flash-smelting furnace.

2. Description of the Related Art

In copper flash-smelting works, copper sulfide concentrate is fed with oil within the flash-smelting furnace and undergoes a gas phase reaction with air or oxygen. Dust carried over dispersed during this smelting process adheres to the water tube of the waste heat boiler in the flash-smelting furnace and reduces the steam yield of the boiler, thereby decreasing the waste heat recovery capacity of the boiler. Moreover, the waste heat boiler in the flash-smelting furnace has the function of recovering and utilizing waste heat attained by the cooling of the high temperature off-gas, including dust exhausted by the flash-smelting furnace; the waste heat boiler in the flash-smelting furnace contains a water tube for recovering waste heat.

In order to resolve the above-mentioned problem, a method was proposed wherein the forced oxidation of the dust is suppressed by feeding nitrogen gas into the waste heat boiler in the flash-smelting furnace, so as to make the dust build-up to the water tube of the waste heat boiler in the flash-smelting furnace unable to soften and be easily removed; furthermore, the dust accretion to the water tube of the waste heat boiler is suppressed by cooling the gas within the furnace and generating turbulence in the gas in the boiler (See Japanese Patent Laid-open No. 6-347001).

By blowing in nitrogen gas with an oxygen concentration of 2% according to the first embodiment in Japanese Patent Laid-open No. 6-347001, the gas temperature at the outlet of the waste heat boiler in the flash-smelting furnace was 30° C. less than before gas was blown in; the amount of accretion to the water tube of the waste heat boiler was reduced and hardening was alleviated.

Also, according to the second embodiment of the above-mentioned citation, in the case of a low extraction rate at sulfuric acid leach of dust recovered with an electrostatic precipitator, the unsulfated dust was oxidized or sulfated, made into red, non-sticky dust, and easily leached by blowing in nitrogen gas with an oxygen concentration of 5% and increasing the partial pressure of oxygen within the waste heat boiler.

However, with the method in the above-mentioned citation, it was found that there were some cases when the accretion to the water tube of dust generated during actual operations could not necessarily be sufficiently suppressed. It is impossible to reduce dust accretion to the water tube because of volatile elements such as lead and zinc included in the ore. It would therefore be desirable to develop a technology which can further reduce the dust generation and more effectively prevent the dust accretion built-up to the water tube.

SUMMARY OF THE INVENTION

In view of the forgoing, it is an object of the present invention to provide a method for operating a flash-smelting furnace which makes it possible to further reduce the amount of dust accretion to the water tube, and so forth, of a waste heat boiler in a flash-smelting furnace of copper flash-smelting works.

The following are means for resolving the above-mentioned issues.

A first aspect of the present invention is a method for operating a waste heat boiler of a flash-smelting furnace of copper flash-smelting works, wherein nitrogen gas and air are blown into the waste heat boiler of the flash-smelting furnace.

A second aspect of the present invention is a method for operating a waste heat boiler in a flash-smelting furnace of copper flash-smelting works, wherein the temperature at the outlet of a waste heat boiler radiation section of the flash-smelting furnace is controlled to be not more than 600° C.

A third aspect of the present invention is a method for operating a waste heat boiler in a flash-smelting furnace of copper flash-smelting works, wherein the oxygen concentration at the outlet of a waste heat boiler radiation section of the flash-smelting furnace is controlled to be in a range of 4 to 8 vol %.

A fourth aspect of the present invention is a method for operating a waste heat boiler in a flash-smelting furnace of copper flash-smelting works, wherein nitrogen gas and air are blow into the waste heat boiler in the flash-smelting furnace and the temperature at the outlet of the waste heat boiler radiation section of the flash-smelting furnace is controlled to be not more than 600° C.

A fifth aspect of the present invention is a method for operating a waste heat boiler in a flash-smelting furnace of copper flash-smelting works, wherein nitrogen gas and air are blown into the waste heat boiler of the flash-smelting furnace and the oxygen concentration at the outlet of a waste heat boiler convection section of the flash-smelting furnace is controlled to be in a range of 4 to 8 vol %.

A fifth aspect of the present invention is a method for operating a waste heat boiler in a flash-smelting furnace of copper flash-smelting works, wherein the temperature at the outlet of a waste heat boiler radiation section of the flash-smelting furnace is controlled to be not more than 600° C. and the oxygen concentration at the outlet of a waste heat boiler convection section of the flash-smelting furnace is controlled to be in a range of 4 to 8 vol %.

A seventh aspect of the present invention is a method for operating a waste heat boiler in a flash-smelting furnace of copper flash-smelting works, wherein nitrogen gas and air are blown into the waste heat boiler of the flash-smelting furnace, the temperature at the outlet of the waste heat boiler radiation section of the flash-smelting furnace is controlled to be not more than 600° C., and the oxygen concentration at the outlet of a waste heat boiler convection-section of the flash-smelting furnace is controlled to be in a range of 4 to 8 vol %.

An eighth aspect of the present invention is the method for operating a waste heat boiler in a flash-smelting furnace, according to aspects 1, 4, 5, or 7, wherein the nitrogen gas and air may be each blown in individually or blended and then blown in.

DETAILED DESCRIPTION OF THE PREFERRED EMBODIMENTS

Figure 1:
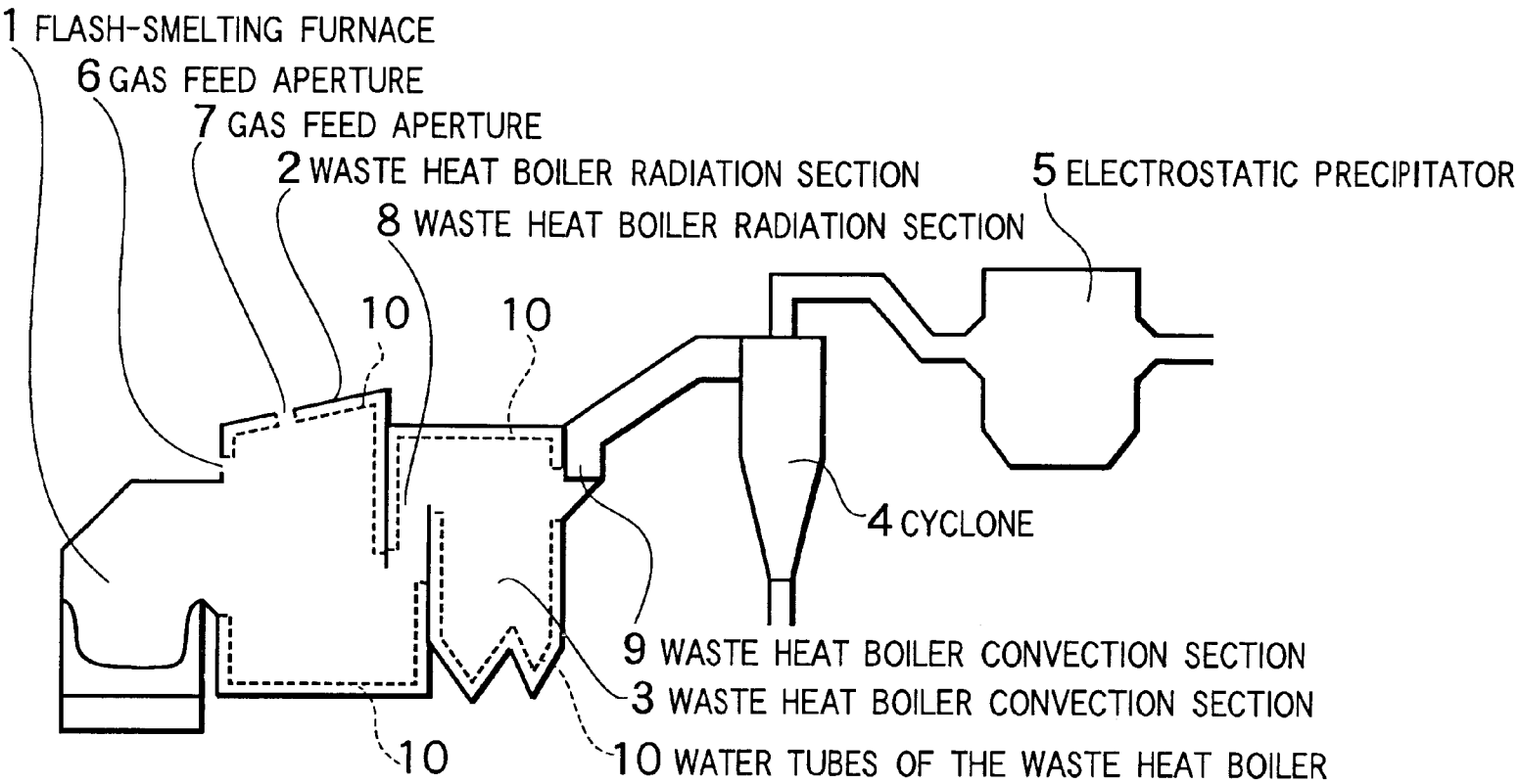
FIG. 1 is a drawing to explain the flash-emitting furnace boiler.

FIG. 1 shows the general form of a flash-smelting furnace for executing the operating method for a flash-smelting furnace relating to the embodiments of the present invention and the waste heat boiler thereof. The operating method of the flash-smelting furnace relating to the embodiments of the present invention is explained below with reference to FIG. 1.

In FIG. 1, the copper concentrate is fed into the flash-smelting furnace 1 along with a burner flame (not shown) and heated and melted. FSF off-gas including dust is generated thereby. The waste heat and dust in the FSF off-gas generated are recovered with the waste heat boiler furnace 2 and waste heat boiler convection section 3. Moreover, the recovered dust is returned to the flash-smelting furnace 1.

Having passed through the boiler convection section 3, the off-gas is sent to a cyclone 4 and electrostatic precipitator 5, where the dust is recovered, then the gas is sent to the sulfuric acid plant. Meanwhile, the recovered dust is sent to a hydrometallurgical plant where valuable components of the dust are recovered.

Dust is formed in the above-mentioned flash-smelting furnace 1 during heating and melting by the burner flame. This generated dust includes particles of ore and oxidation products thereof. In a semi-molten state, these adhere to the water tube 10 of the waste heat boiler. As is known, the water tube 10 of the waste heat boiler are disposed throughout the walls of the boiler radiation section 2 and the convection section 3 and are also suspended within the boiler convection section 3.

The method relating to the present invention concerns blowing nitrogen gas and air from the gas feed aperture 6 located in the front wall portion of the waste heat boiler radiation section 2 and/or the gas feed aperture 7, or the like, located in the upper portion.

The proportions of the air and nitrogen gas blown in and/or the flow rates of each are established so that the oxygen concentration within the waste heat boiler radiation section 2 becomes a certain concentration.

The air blown in may be compressed air at normal temperatures and pressures and may be forced in using a fan.

The nitrogen gas and air may also be blended at certain proportions in advance and then blown in, or blown in separately and blended within the waste heat boiler radiation section 2. In this case, blending means may be established within the waste heat boiler radiation section 2 in order to promote blending.

It is optimal that the nitrogen and air be blown in so that the oxygen concentration in the off-gas becomes 4 to 8 vol % according to a measurement apparatus near the outlet 9 of the waste heat boiler convection section 3.

Controlling the oxygen concentration controls the oxidation of the dust; this does not generate sticky dust and makes dust accretion to the water tube 10 of the waste heat boiler very easy to remove. Also, regulating the sulfation at the same time can result in non-sticky dust. Furthermore, it is thereby possible to increase the leaching rate of the recovered dust in the hydrometallugical plant.

According to the research by the inventors, dust is affected by changes in temperature, which result in varying degree of oxidation. When the temperature near the outlet 8 of the waste heat boiler radiation section 2 becomes 600° C. or greater, sulfation is promoted and damage to off-gas facilities tends to accelerate. Based on these results, the above-mentioned problems can be eliminated by making the temperature at the outlet 8 of the waste heat boiler radiation section 2 less than 600° C.

Furthermore, the results of further studies showed that blowing in nitrogen gas and air and blending them in the waste heat boiler radiation section 2 can dilute and cool the off-gas and reduce the temperature at the outlet 8 of the waste heat boiler radiation 2 to below 600° C.

It is possible to blow in only nitrogen gas and utilize the cooling effects of the gas to reduce the temperature at the outlet 8 of the waste heat boiler radiation section 2 to less than 600° C. However, the property of the dust (oxidation degree, etc.) cannot be controlled using only nitrogen gas; the desired effects cannot be attained and this is not realistic in terms of costs either.

The best results with the method of the present invention are attained by blowing in nitrogen gas and air so that the oxygen concentration in the off-gas near the outlet 9 of the waste heat boiler convection section 3 becomes 4 to 8% (preferably 5 to 7%), and at the same time, the temperature at the outlet 8 of the waste heat boiler radiation section 2 becomes less than 600° C. The quantity of dust adhered to the water tube 10 of the waste heat boiler can thereby be decreased to less than ⅔ compared to conventional methods; also, the time need for offline operations of the flash-smelting furnace can be greatly reduced.

First Embodiment

Copper concentrate was charged at a rate of 48 t/hr from the concentration burner in the upper portion of the flash-smelting furnace 1. Generated in the melting process, off-gas including dust was drawn into the waste heat boiler radiation section 2 connected to the flash-smelting furnace 1; the temperature at the inlet of the waste heat boiler radiation section 2 at this time was 1250° C.

A mixed gas of air blended with nitrogen gas and comprising 13% oxygen by volume was blown at a rate of 2500 $Nm^3$/hr through a gas feed aperture 6 established in the upper portion of the front wall of the waste heat boiler radiation section 2. At this time, the concentration of oxygen in the off-gas near the outlet 9 of the waste heat boiler convection section 3 was 5 vol % and the temperature near the outlet 8 of the waste heat boiler radiation section 2 was 585° C.

When the surface of the water tube 10 of the waste heat boiler was examined during offline operations for the flash-smelting furnace in this embodiment, dust was found to be adhered in the vicinity of the boiler inlet, but the thickness thereof was very thin, less than several mm. Before now, adhesion was observed on all water tubes, while in the vicinity of this inlet, dust accretion was as much as 100 to 200 mm thick or more.

Second Embodiment

Copper concentrate was charged at a rate of 48 t/hr from the concentrate burner in the upper portion of the flash-smelting furnace 1. Generated in the melting process, off-gas including dust was drawn into the waste heat boiler radiation section 2 connected to the flash-smelting furnace 1; the temperature at the inlet of the waste heat boiler radiation section 2 at this time was 1230° C.

A mixed gas of air blended with nitrogen gas and comprising 16% oxygen by volume was blown at a rate of 3000 $Nm^3$/hr through a gas feed aperture 6 established in the upper portion of the front wall of the waste heat boiler radiation section 2. At this time, the concentration of oxygen in the exhaust gas near the outlet 9 of the waste heat boiler convection section 3 was 6.5 vol % and the temperature near the outlet 8 of the waste heat boiler radiation section 2 was 583° C.

When the surface of the water tube 10 of the waste heat boiler was examined during offline operations for the flash-smelting furnace in this embodiment, a certain amount of dust was found to be adhered to the water tube 10 of the waste heat boiler, but this was observed to be dust which was not hardened, was already cracking in various places, and was in a form which would easily come off.

Third Embodiment

Copper concentrate was charged at a rate of 46 t/hr from the concentrate burner in the upper portion of the flash-smelting furnace 1. Generated in the melting process, off-gas including dust was drawn into the waste heat boiler radiation section 2 connected to the flash-smelting furnace 1; the temperature at the inlet of the waste heat boiler radiation section 2 at this time was 1200° C.

A mixed gas of air blended with nitrogen gas and comprising 14% oxygen by volume was blown at a rate of 2500 $Nm^3$/hr through a gas feed aperture 6 established in the upper portion of the front wall of the waste heat boiler radiation section 2. At this time, the concentration of oxygen in the off-gas near the outlet 9 of the waste heat boiler convection section 3 was 4 vol % and the temperature 2 was 590° C.

When the surface of the water tube 10 of the waste heat boiler was examined during offline operations for the flash-smelting furnace in this embodiment, dust adhesion was observed, but was mostly in a form such that it naturally dropped off as a result of cooling during spot inspection. Before now the dust adhered was in a hardened form which could only be removed manually.

Comparison Example

Copper concentrate was charged at a rate of 46 t/hr from the concentrate burner in the upper portion of the flesh-smelting furnace 1. Generated in the melting process, off-gas including dust was drawn into the waste heat boiler radiation section 2 connected to the flash-smelting furnace 1; the temperature at the inlet of the waste heat boiler radiation section 2 at this time was 1210° C.

Nitrogen gas (oxygen concentration of 0 vol %) was blown at a rate of 1500 $Nm^3$/hr through a gas feed aperture 6 established in the upper portion of the front wall of the waste heat boiler furnace 2. At this time, the concentration of oxygen in the off-gas near the outlet 9 of the waste heat boiler convection section 3 was 1 vol % and the temperature near the outlet 8 of the waste heat boiler radiation section 2 was 700° C.

When the surface of the water tube 10 of the waste heat boiler was examined during offline operations for the flash-smelting furnace in this embodiment, dust was adhered to thicknesses of several hundred mm on many portions of the surface starting near the inlet and was in a form which did not easily separate.

Figure 2:
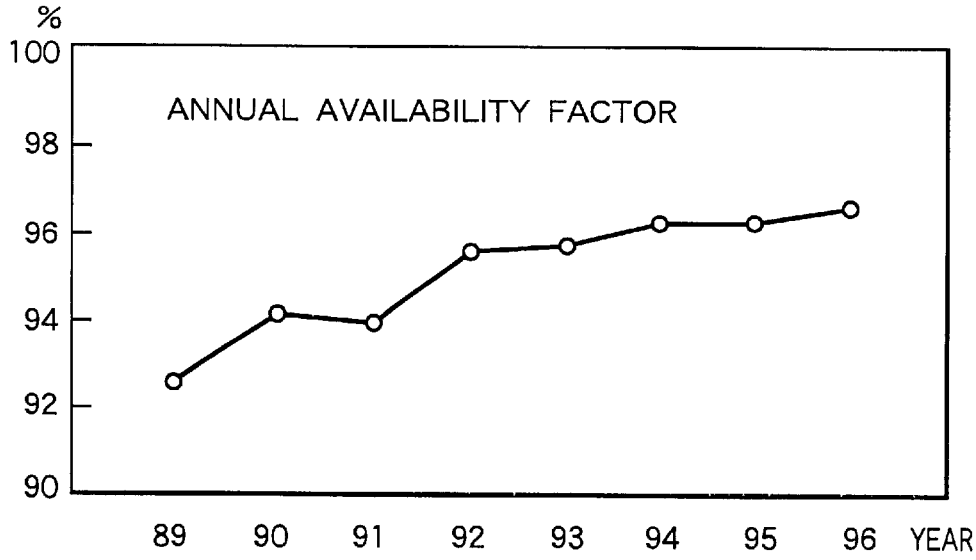
FIG. 2 is a transition graph of the annual on-line ratio of the flash-smelting furnace.
Figure 3:
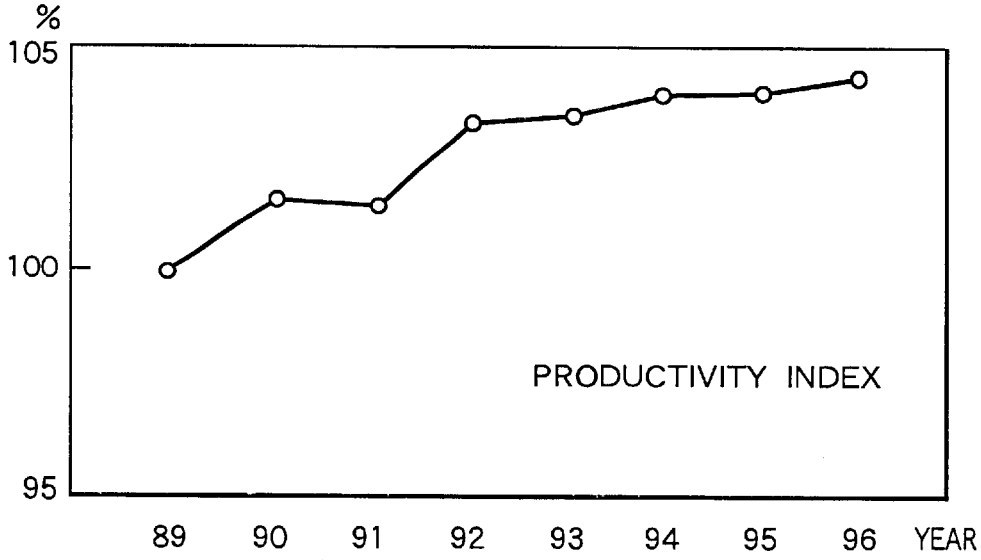
FIG. 3 is a transition graph of the productivity index of the flash-smelting furnace.

The present invention can further lengthen the intervals between boiler cleanings and increase both the annual on-line ratio factor and productivity index for flash-smelting furnace operations by 5%, as shown in the annual availability factors in FIG. 2 and the productivity indexes in FIG. 3.

As discussed above, the present invention makes it possible to control the oxidation of dust and the temperature at the boiler outlet and to reduce the amount of dust accretion to the water tube, by blowing air and nitrogen gas from feed apertures into a waste heat boiler in a flash-smelting furnace. The present invention can thereby greatly improve the problems such as reduced flash-smelting furnace availability factor and productivity due to boiler cleaning, and increased labor loads on staff.

What is claimed is:

1. A method for operating a waste heat boiler in a flash-smelting furnace of copper flash-smelting works, wherein the oxygen concentration at the outlet of a waste heat boiler convection section of the flash-smelting furnace is controlled to be in a range of 4 to 8 vol %.

2. A method for operating a waste heat boiler in a flash-smelting furnace of copper flash-smelting works, wherein nitrogen gas and air are blown into the waste heat boiler in the flash-smelting furnace and the oxygen concentration at the outlet of a waste heat boiler convection section of the flash-smelting furnace is controlled to be in a range of 4 to 8 vol %.

3. A method for operating a waste heat boiler in a flash-smelting furnace of copper flash-smelting works, wherein the temperature at the outlet of a waste heat boiler radiation section of the flash-smelting furnace is controlled to be not more than 600° C. and the oxygen concentration at the outlet of a waste heat boiler convection section of the flash-smelting furnace is controlled to be in a range of 4 to 8 vol %.

4. A method for operating a waste heat boiler in a flash-smelting furnace of copper flash-smelting works, wherein nitrogen gas and air are blown into the waste heat boiler in the flash-smelting furnace, the temperature at the outlet of a waste heat boiler radiation section of the flash-smelting furnace is controlled to be not more than 600° C., and the oxygen concentration at the outlet of a waste heat boiler convection section of the flash-smelting furnace is controlled in the range of 4 to 8 vol %.

5. The method for operating a waste heat boiler in a flash-smelting furnace, according to claim 2, wherein the nitrogen gas and air are each blown in individually or blended and then blown in.

6. The method for operating a waste heat boiler in a flash-smelting furnace, according to claim 4, wherein the nitrogen gas and air are each blown in individually or blended and then blown in.

* * * * *